US006390009B2

(12) United States Patent
Brown et al.

(10) Patent No.: US 6,390,009 B2
(45) Date of Patent: May 21, 2002

(54) ADJUSTABLE SHOCK ABSORBING MOORING AND UTILITY LINE

(76) Inventors: Jason Aaron Brown, 400 Eagle Bend La., Clinton, TN (US) 37716; Paul B. Pehrson, 11909 Yarnell Rd., Knoxville, TN (US) 37923

( * ) Notice: Subject to any disclaimer, the term of this patent is extended or adjusted under 35 U.S.C. 154(b) by 0 days.

(21) Appl. No.: 09/760,260

(22) Filed: Jan. 12, 2001

Related U.S. Application Data

(60) Provisional application No. 60/176,942, filed on Jan. 18, 2000.

(51) Int. Cl.[7] ..... B63B 21/00

(52) U.S. Cl. ..... 114/230.24; 267/69

(58) Field of Search ..... 114/213, 215, 114/230.1, 230.2, 230.22, 230.24; 267/69

(56) References Cited

U.S. PATENT DOCUMENTS

| | | | | | |
|---|---|---|---|---|---|
| 3,860,226 | A | * | 1/1975 | Hensiek, Jr. | 267/69 |
| 3,931,656 | A | * | 1/1976 | Thomson | 267/69 |
| 4,044,415 | A | * | 8/1977 | Wood | 267/69 |
| 4,597,351 | A | | 7/1986 | Brainard | |
| 4,681,303 | A | | 7/1987 | Grassano | |
| 4,995,329 | A | | 2/1991 | Kleine | |
| 5,083,522 | A | * | 1/1992 | Ashrow | 114/215 |
| 5,524,566 | A | | 6/1996 | Rapa | |
| 5,803,439 | A | | 9/1998 | Gillmore | |
| 6,142,889 | A | * | 11/2000 | Schaubach | 473/426 |

* cited by examiner

*Primary Examiner*—Stephen Avila

(57) ABSTRACT

A shock absorbing and adjustable-length mooring and utility securing line for mooring a boat to a dock in a marine environment utilizes a hollow flexible tubing constructed of substantially inelastic fabric material and a bungee cord disposed within the tubing. The hollow tubing has a central section disposed between the opposite ends of the tubing, and the fabric material of the central section is movable lengthwise between a gathered condition and a fully-stretched condition to accommodate a lengthening of the line as the opposite end portions of the central section are moved farther apart from a condition at which the central section is in a gathered condition and to accommodate a shortening of the line as the opposite end portions of the central section are moved closer together from a condition at which the central section is in a fully-stretched condition. The bungee cord is attached to the central section of the tubing for biasing the end portions of the central section toward one another to thereby bias the central section from the fully-stretched condition toward the gathered condition.

20 Claims, 3 Drawing Sheets

ADJUSTABLE SHOCK ABSORBING MOORING AND UTILITY LINE

The benefit of Provisional Application Ser. No. 60/176,942, filed Jan. 18, 2000 and entitled Adjustable Shock Absorbing Mooring and Utility Line, is hereby claimed. The disclosure of this referenced provisional application is incorporated herein by reference.

BACKGROUND OF THE INVENTION

This invention relates generally to the attaching of two objects together wherein the objects are capable of moving toward and away from one another, particularly, to lines used to attach said objects to one another.

The popularity of recreational water sports and water sports has increased greatly over the last decade as seen by increased recreational sales. This too has increased ownership of personal watercrafts and boats that include yachts, rafts, canoes, kayaks, pontoon boats and ski boats. As used herein, the term "boat(s)" is intended to include any watercraft or boat.

An issue with owning boats, and especially motorized boats, is the docking of them. Not only is it helpful to have an experienced staff to operate a boat, but also it is also helpful that the staff and the captain have the knowledge of securing the boat properly to the item that the captain has decided to dock with. This item will be referred to as docking object throughout the rest of the text. Also, the act of docking a boat will be referred to as mooring. Rope is generally the item used as mooring line to secure boats to a docking object. Rope used to as mooring line, typically, is made of either nylon or cotton. Rope tying experience is recommended for securing a boat to a dock, and there are many different rope-tying methods for docking a boat that can be used. Most novices and inexperienced boaters are unsure of how to moor a boat and can use overly complex and in turn, inadequate, securing methods with the line in efforts to ensure that the boat will stay where it was parked. Novice rope tying efforts in mooring a boat can be time consuming and inadequate, and can eventually cause the boat to become unsecured.

Another concern other than securing the boat to a docking object is the question of how tightly to secure the boat and the distance the boat is to be secured away from the the docking object. A boat secured too tightly will lead to greater and more frequent impacts with the docking object. When secured too loosely a boat is able to gain momentum before collision with the docking object. In the case of mooring a boat to four posts as commonly occurs for long-term mooring, the object is normally to keep an equal distance between the posts and the boat. This can prove to be a complex task for the inexperienced.

Mooring lines made of cotton or nylon do not cushion a boat's abundant rocking caused mainly by: wakes created by passing boats; persons moving about a boat; waves, or the like. Rocking motions generally lead a boat to impact with the docking object if secured closely with the docking object. Currently, marine bumpers accomplish cushioning a boat from such impacts. Marine bumpers are sold abundantly throughout the water sports market and can be found in most marine equipment retail stores. Marine bumpers are placed between the boat and the docking object, generally, to dampen the impact between the two objects. If not for the marine bumpers, the boat is allowed to impact with the docking object directly. The force of a boat rocking back and forth against a docking object can have harmful effects on a moored boat.

To further explain the force that a boat receives while docked, a great deal can be explained by examining the mooring line used to moor a boat. It is very well known that the wake from a passing vessel causes the mooring lines of the boat to first relax, gathering some slack, and then as the wave ebbs, the lines become taut imparting a shock in the line which is transmitted to the boat itself. This is particularly unpleasant if the boat serves as a residence especially at times when the crew is aboard is seeking some rest. The shocks applied are disruptive as well as having deleterious effects on the mooring lines, boat and dock. Repeated applications of impact loads gradually stretch and weaken the mooring lines, and can damage boat and docking objects.

Literature has been found for several different types of shock absorbers for accommodating the tensile shock loads in anchor cables and mooring lines. One of the simplest solutions to the problem was to wrap the mooring line around a length of elastic rubber material such that the rubber served to tighten the lines as shown in U.S. Pat. No. 3,817,507 to Derman. This construction tended to wear out quickly and was marginally effective in controlling the larger shocks in the associated mooring lines. Another arrangement was to use a spring mounted in a frame so that the pull upon the line tended to compress the spring that, when the tensile forces in the line diminished to less than the spring force, the spring reacted to diminish the shock effect. Such apparatus was noisy and thus interfered with the comfort of those living on, say, a houseboat, and springs from contact with seawater had a short service life and often failed. One such spring arrangement is shown in the Strain, et al. U.S. Pat. No. 4,967,681, which incorporated a nest of springs in a housing mounted so that the springs compress as tensile loads were applied to members in the housing supporting the springs. Such of an arrangement is costly to manufacture and all the springs are vulnerable to the corrosive effect of water.

Other metal and mechanical items attempting the effect of reducing shock can be seen in U.S. Pat. Nos. 3,094,096, 4,754,957, and 5,524,566, all vulnerable to the corrosive effects of water.

With any of these previous, mechanical shock absorbing devices listed also come difficulties associated with their use. Shock absorbing implements to use in conjunction with typical mooring lines have been constructed of abrasive and non-pliable, rigid material that can be detrimental or harming to a boat. The materials have been comprised of steel that can cause damage to a boat as well as the docking object to which it is moored. Storing of the many mechanical models is often difficult due to size, shape and material composition.

Not only are the shock absorbing apparatuses apparently detrimental, but generally the designs have not been incorporated into a line that are made easy enough for most anyone to use. Most shock absorbers have been designed as an insert into a mooring line. The claimed line has incorporated ease of use, adjustable length and shock absorbing components all in one unit.

Easy to use and shock absorbing is a combination that would best help boat owners and users enjoy water leisure activities as well as other activities where complicated rope and knot tying are used in: securing two items together; securing one item to another, or other tying needs. A mooring line with components familiar to the inexperienced and novice boat users, and even experienced boat users, can assist in making a difficult mooring task easier.

It is an object of the present invention to provide a new and improved line for attaching two objects together.

Another object of the present invention is to provide such a line which is particularly well suited for attaching two objects together in a marine environment, such as a boat to a dock.

Yet another object of the present invention is to provide such a line which is uncomplicated in construction yet effective in operation.

SUMMARY OF THE INVENTION

This invention resides in a line for attaching two objects together wherein the two objects are capable of moving toward and away from one another.

The line includes a length of tubing constructed of substantially inelastic fabric material and having two opposite ends which are each adapted to be attached to a corresponding one of two objects for attaching the two objects together with the line. In addition, the length of tubing has a central section disposed between its opposite ends wherein the central section has opposite end portions, and the fabric material of the central section is movable lengthwise between a gathered condition and a fully-stretched condition to accommodate a lengthening of the line as the opposite end portions of the central section are moved farther apart from a condition at which the central section is in a gathered condition and to accommodate a shortening of the line as the opposite end portions of the central section are moved closer together from a condition at which the central section is in a fully-stretched condition.

The line also includes biasing means acting upon the central section for biasing the end portions of the central section toward one another to thereby bias the central section from the fully-stretched condition toward the gathered condition. When the opposite ends of the tubing are attached between two objects capable of moving toward and away from one another, the biasing means opposes the movement of the two objects away from one another and the distance that the two objects can be moved away from one another is limited by the length of the central section when in its fully-stretched condition. Furthermore, when the two objects move toward one another from the condition at which the central section is in its fully-stretched condition, the biasing means biases the central section toward the gathered condition.

In one embodiment of the invention, the line is a nearly infallible shock absorbing and adjustable length mooring and utility line capable of use by all users, i.e. from the novice to experienced boat hands, and for general tying occasions. The adjustable shock absorbing mooring and utility line has an unequivocal benefit when used to moor boats in that it reduces physical stress exerted on the boat caused by waves and other motion that normally causes the boat to rock or thrash while in the water. Such motions can cause damage to the vehicle if allowed to rock freely. The other benefits of the adjustable shock absorbing mooring and utility line include: a design so that it can be used to secure boat easily with little if any rope-tying experience or knowledge; easy-to-use hardware components known to most; can be manufactured with a varied thickness and design of materials in order to accommodate the needs of boat, all outdoor, and even indoor uses as required; ease of construction and manufacturing; few parts vulnerable to water corrosion or wear, and stores compactly and easily. The line, as in the preferred embodiment, eliminates rope tying skills required by boat owners and users. The length of the line is easily adjustable and accommodates several mooring uses with many different attachment options.

DETAILED DESCRIPTION OF THE ILLUSTRATIVE EMBODIMENT

Figure 1:
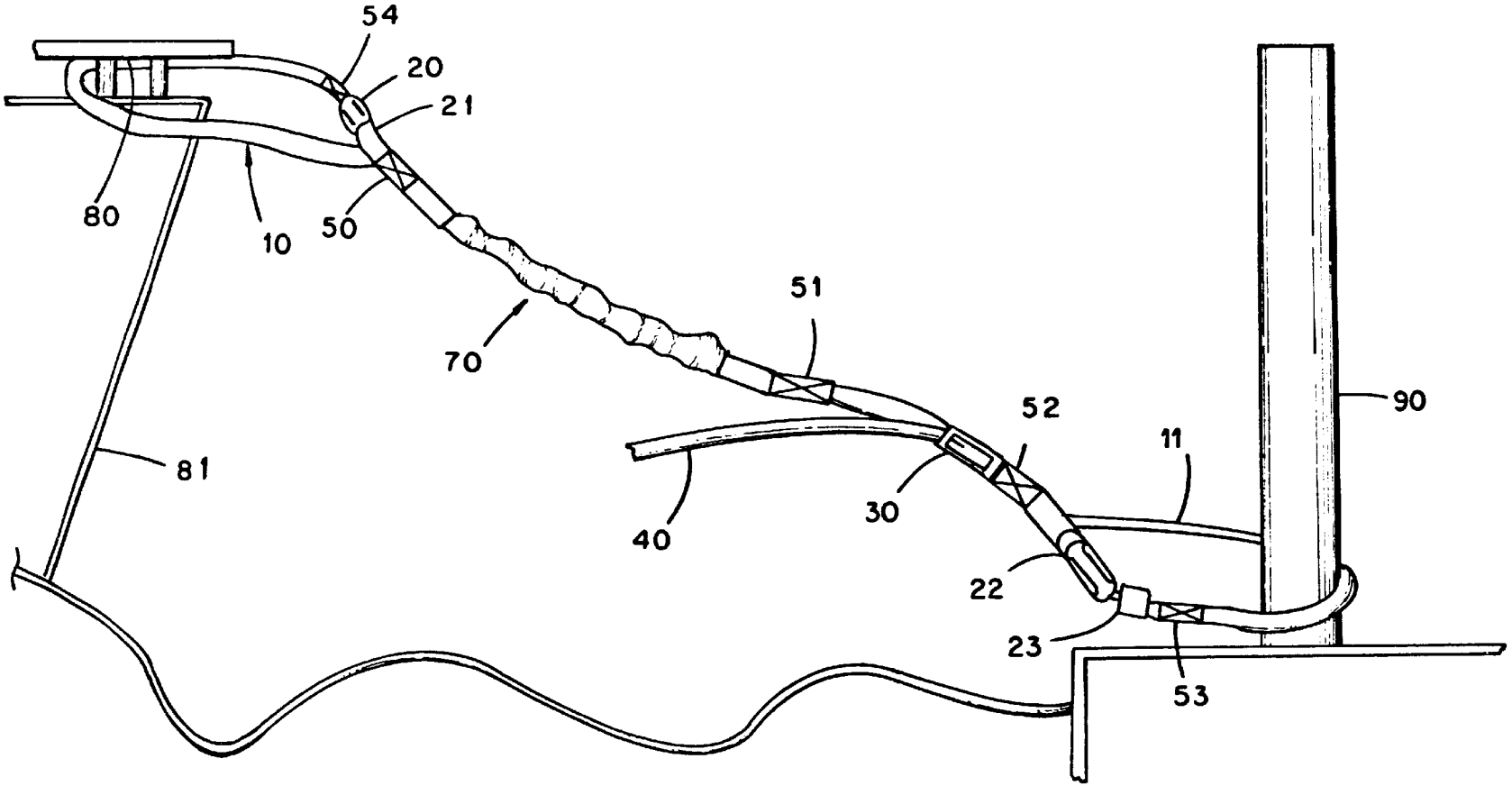
FIG. 1 is a perspective view of the adjustable shock absorbing mooring and utility line in its preferred use for attaching a boat to a fixed docking object.

FIG. 1 illustrates the line as depicted in one embodiment as an adjustable shock absorbing mooring and utility line as it would be used with a typical boat 81 but also applies to all other boats. The application is basically one of securing one or more objects together and this, in turn, can be applied to any two objects. The first securing end 10 is attached to the depicted boat cleat 80 and the second securing end 11 of the adjustable shock absorbing mooring and utility line is secured to a fixed docking object 90. The adjustable shock absorbing mooring and utility line is attached to a docking object 90 using the securing end 11 that incorporates a buckle comprised of a male 22 side and an adjoining female 23 side. Materials used for the line is flexible fabric such as nylon webbing. The line 70 is depicted in detail in FIG. 2. Stitching is used to collapse the tubing at selected intervals (noted 50 and 51) in FIG. 1 to a flattened condition. Stitching is also used to incorporate and fasten the securing end pieces together (noted 52, 53, and 54) as seen in FIG. 1.

At both ends of the adjustable shock absorbing mooring and utility line are securing ends 10 and 11 fitted with hardware 21, 22, 23 and 24. This hardware aids to provide easy securing options. The ends can be uncoupled in order to wrap the ends around an object 90 and then secure the closure by joining the buckle pieces (male 21 with female 20 and male 23 with female 22) back together.

The securing ends 10 and 11 can remain fastened and serve a lasso or loop that can also aid in securing an object, such as the boat 81 depicted in FIG. 1. The securing end 10 can be left buckled, forming a loop that can be used as any loop as a securing option. One securing option for the securing end 10 left fastened to form a loop is depicted in FIG. 1 to secure around the boat cleat 80.

Once the securing ends 10 and 11 are fastened to the intended docking or securing objects 81 and 90, the length of the line can be adjusted by the use of the adjusting strap 40 and the buckle 30. The buckle 30 construction design resists the strap 40 from freely feeding back through the buckle 30 without applying upward force on the buckle 30 first. The buckle 30 assists in keeping the desired, adjusted length.

The fastening ends 10 and 11 are incorporated to either the adjusting buckle 30 or directly 50 to the shock absorbing line 70. The second fastening end 11, as seen in FIG. 1, is attached directly to the adjusting buckle 30. The adjustment strap 40 is used in cooperation with the adjusting buckle 30.

Figure 2:
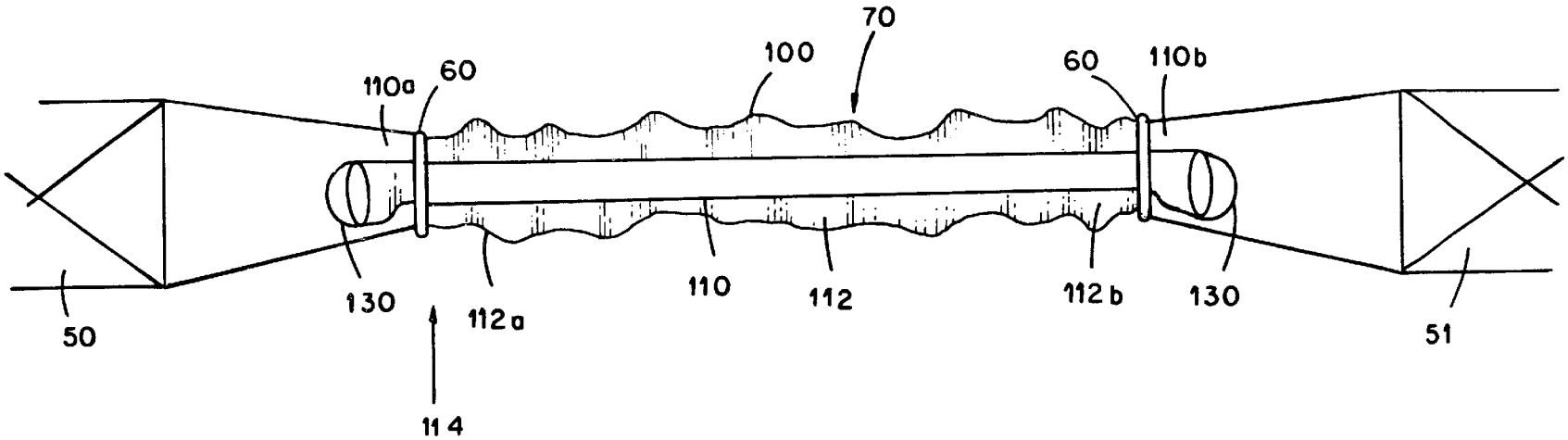
FIG. 2 is a longitudinal cross-sectional view of the shock-absorbing mechanism for the line of FIG. 1.

FIG. 2 depicts a sectional view of the line 70. The line 70 includes a shock absorbing material 110 and a length of tubing 112. The shock absorbing material 110 of the depicted line 70 is comprised of a length of elastomeric (e.g. bungee) cord and having two opposite end portions 110*a* and 110*b*. The bungee cord is capable of being stretched lengthwise from a relaxed condition to a stretched condition as the two end portions 110*a* and 110*b* are pulled apart, and its elastomeric nature returns the bungee cord to a shortened, or relaxed condition as the two end portions 110*a* and 110*b* are permitted to be moved toward one another or released. Moreover, the elastomeric nature of the bungee cord continually biases the two end portions 110*a* and 110*b* toward one another when the opposite ends of the line 70 are pulled apart.

The tubing 100, on the other hand, is comprised of a substantially inelastic, albeit flexible, fabric, such as tightly-woven nylon, having a relatively high tensile strength. In addition, the tubing 100 includes a central section 112 having two opposite end portions 112*a* and 112*b* and which is disposed along the length of the tubing 100 inboard of the opposite ends of the line 70. As is apparent herein, the fabric material of the central section 112 is movable lengthwise between a gathered condition (as best shown in FIG. 2) and a fully stretched condition to accommodate a lengthening of the line 70 as opposite end portions 112*a* and 112*b* of the central section 112 are moved farther apart from a condition at which the central section is in a gathered condition and to accommodate a shortening of the line 70 as the opposite end portions 112*a* and 112*b* of the central section 112 are moved closer together from a condition at which the central section is in a fully-stretched condition. In the interests of the present invention, the central section 112 is in a "gathered condition" when its fabric exhibits wrinkles and folds which extend (annularly) around the central section 112 so as to provide the central section 112 with somewhat of a pleated appearance.

As best shown in FIG. 2, the shock absorbing material 110 is disposed within the central section 112 of the tubing so that the end portion 110*a* of the shock absorbing material 110 is disposed within (and thus corresponds to) the end portion 112*a* of the central section 112, and so that the end portion 110*b* of the shock absorbing material 110 is disposed within (and thus corresponds to) the end portion 112*b* of the central section 112. In the depicted FIG. 2 view, the central section 112 is arranged in a gathered condition (to accommodate a lengthening of the central section 112 as the end portions 112*a* and 112*b* are pulled apart), and the shock absorbing material 100 is in a relaxed condition.

Each end portion 110*a* or 110*b* of the shock absorbing material 110 is fixedly secured to a corresponding end portion 112*a* or 112*b* with attaching means, generally indicated 114 in FIG. 2. Although the attaching means 114 can take any of a number of forms, it preferably includes means for tightly binding each end portion 112*a* or 112*b* of the central section 112 about a corresponding end portion 110*a* or 110*b* of the shock absorbing material 110 so that the end portions are tightly bound together. In one embodiment 70, the binding means can take the form of a metal clamp which is tightly clamped about each end portion 112*a* or 112*b*, and in another embodiment, the attaching means can take the form of a clamp which is tightly secured about end portion 112*a* and 112*b* and a heat-shrinkable plastic sleeve, and applicable sleeving means, tightly positioned about the end portions 112*a* and 112*b*.

To further reduce the likelihood that the end portions 110*a* or 10*b* could pull free, that thus become detached from, the end portions 112*a* or 112*b*, each end of the shock absorbing material 110 can be folded over and secured upon itself to form a knot 130 disposed outboard of the attaching means 114. These formed knots 130 will render it more difficult for the end portions 110*a* or 110*b* to slide through the attaching means 114.

When assembling the line 70, the shock absorbing material 110 is placed within the central section 112 in a relaxed condition and the central section 112 is gathered lengthwise to its gathered condition so that the each end portion 112*a* or 112*b* corresponds with a corresponding end portion 110*a* or 110*b* of the shock absorbing material 110. The attaching means 114 are then secured about the central section end portions so that each end portion 110*a* or 110*b* is tightly bound within the end portion 112*a* or 112*b*. With the shock absorbing material 110 secured within the central section 112 in this manner, the central section 110 is free to lengthen from its gathered (FIG. 2) condition (as the opposite ends of the line 70 are pulled apart) to a fully stretched condition as the shock absorbing material is stretched from its relaxed condition toward its stretched condition.

It is also a feature of the line 70 that as the opposite ends of the line are pulled apart, the central section 112 reaches its fully-stretched condition before the shock absorbing material reaches its fully-stretched condition. This way, when the opposite ends of the line 70 are pulled apart to the limit permitted by the lengthening of the central section 112 from its gathered condition, the shock absorbing material is not exposed to (tensile) forces that can damage or break the shock absorbing material 110. It follows that tensile forces exerted upon the line 70 (i.e. those forces which pull the end portions 112*a* and 112*b* apart to a fully stretched condition) which would otherwise stretch the shock absorbing material to a length beyond its (stretched) length corresponding with the fully-stretched condition of the central portion 112 are resisted and supported by the high tensile strength fabric of the tubing 100, rather than being entirely supported by the shock absorber material 110. Further still, the elastomeric strength of the shock absorbing material is such that when the opposite ends of the line 70 are permitted to move toward one another from the fully-stretched condition of the central section 110, the shock absorbing material 110 returns the central section 110 toward its gathered (FIG. 2) condition as the shock absorbing means 110 returns toward its relaxed condition.

Shock absorbing material 110 is covered by the tubing 100. The ends of the shock absorbing material 110 are doubled over as depicted in FIG. 2 and as in FIG. 4 and FIG. 5 of U.S. Pat. No. 5,187,852, and FIG. 11 of U.S. Pat. No. 5,682,652. The shock absorbing material 110 is folded over on to itself and a clamp 60 is fastened around the shock absorbing material to create a knot 130. Another clamp 60 is secured around the tubing with the shock absorbing material 110 inside.

Figure 3:
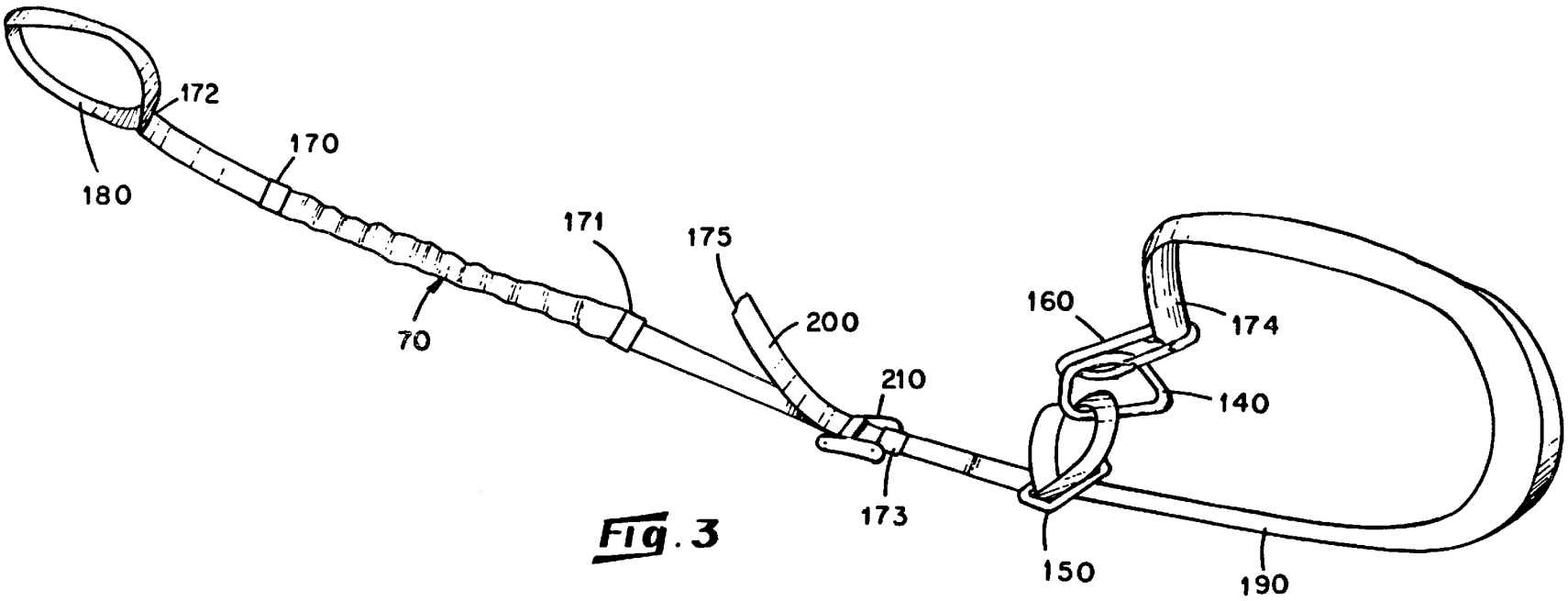
FIG. 3 is a perspective view of an alternative embodiment of the line which incorporates alternate hardware for the securing ends.

FIG. 3 illustrates a method of incorporating alternate hardware to fashion alternate securing ends 180 and 190. Securing end 180 comprises of fabric webbing (as proposed use in FIG. 1) fastened to itself creating a loop. This securing end 180 is directly attached to the line 70. The line 70 is then directly attached to the adjusting strap 200. The adjusting strap 200 incorporates an adjusting buckle 210 just as the method demonstrated in FIG. 1. The second securing end 190 is constructed with sliding components 150 and 140 that allow for travel up or down the length of the second securing end 120. The fabric webbing of the second securing end 120 is incorporated into the sliding components 130 and 140 such that the sliding components 130 and 140 can travel toward the adjusting buckle 30 to create a larger diameter loop. The sliding components 130 and 140 can also be adjusted away from the adjusting buckle to decrease loop size of the second securing end 120. The fastening clip 160 is used in cooperation with the sliding components 130 and 140 to create a loop at the second securing end 120. The fastening clip 160 alone can be used to fasten to an object. Stitching is used to collapse the tubing at selected intervals (noted 170 and 171) in FIG. 3 to a flattened condition. Stitching is also used to incorporate and fasten the securing end pieces (noted 172, 173, and 174) as seen in FIG. 3.

It is recognized that variations and modifications will occur to those skilled in the art, and it is intended that all such modifications and variations be included within the scope of the appended claims.

What is claimed is:

1. A line for attaching two objects together wherein the two objects are capable of moving toward and away from one another, said line comprising:

a length of tubing constructed of substantially inelastic fabric material and having two opposite ends which are each adapted to be attached to a corresponding one of two objects for attaching the two objects together with the line;

the length of tubing having a central section disposed between its opposite ends wherein the central section has opposite end portions and the fabric material of the central section is movable lengthwise between a gathered condition and a fully-stretched condition to accommodate a lengthening of the line as the opposite end portions of the central section are moved farther apart from a condition at which the central section is in a gathered condition and to accommodate a shortening of the line as the opposite end portions of the central section are moved closer together from a condition at which the central section is in a fully-stretched condition;

biasing means acting upon the central section of the tubing for biasing the end portions of the central section toward one another to thereby bias the central section from the fully-stretched condition toward the gathered condition so that when the opposite ends of the tubing are attached between two objects capable of moving toward and away from one another, the biasing means opposes the movement of the two objects away from one another and the distance that the two objects can be moved away from one another is limited by the length of the central section when in its fully-stretched condition and so that when the two objects move toward one another from the condition at which the central section is in its fully-stretched condition, the biasing means biases the central section toward the gathered condition, and wherein the biasing means is elongated in form and has two opposite ends which are capable of being stretched lengthwise from a relaxed condition toward a stretched condition, and wherein the biasing means is disposed in such a relation to the central section so that each end portion of the biasing means corresponds with an end portion of the central section; and means for attaching each end portion of the central section to a corresponding end portion of the biasing means so that the entire stretchable length of the biasing means is captured between the end portions of the central section and so that when the biasing means is in its relaxed condition, the central section of the tubing is in its gathered condition and so that when the line is lengthened to the fully-stretched condition of the central section, the central section of the tubing prevents the elongation of the entire stretchable length of the biasing means beyond the stretched condition of the biasing means.

2. The line as defined in claim 1 wherein the biasing means includes a bungee cord having two opposite end portions wherein each end portion of the bungee cord provides a corresponding end of the biasing means, and wherein the bungee cord is disposed within the central section of the tubing so that each end portion of the bungee cord means corresponds with an end portion of the central section.

3. The line as defined in claim 2 wherein the means for attaching includes means for tightly binding each end portion of the central section about a corresponding end portion of the bungee cord.

4. The line as defined in claim 3 wherein the bungee cord includes at least one end which is folded over and secured upon itself and wherein the folded end of the bungee cord is positioned at a location along the length of the tubing which is disposed outboard of the means for tightly binding to reduce the likelihood that the means for tightly binding can be pulled over the folded end of the bungee cord.

5. The line as defined in claim 1 further comprising means associated with at least one of the opposite ends of the tubing for securing the at least one end of the tubing to a corresponding one of the two objects to be attached together.

6. The line as defined in claim 5 wherein the associated means includes strap means including a portion which can be looped about a corresponding one of the two objects to be attached together.

7. The line as defined in claim 6 wherein the material of the strap means is integrally formed with the material of the tubing.

8. The line as defined in claim 6 wherein the portion of the strap means capable of being looped includes sections which can be attached to one another to form a loop positionable about the corresponding one of the two objects to be attached together and which can be detached from one another to release the corresponding one of the two objects from the strap means.

9. The line as defined in claim 8 further comprising buckling components attached to the sections of the strap means and to one another to accommodate an adjustment in the size of the loop capable of being formed with the strap means.

10. The line as defined in claim 6 wherein the strap means includes means for adjusting the distance between the loop and the corresponding end portion of the central section to thereby adjust the total length of the line.

11. A shock absorbing and adjustable-length mooring and utility securing line for attaching two objects together wherein the two objects are capable of moving toward and away from one another, said line comprising:

a hollow flexible tubing constructed of substantially inelastic fabric material and wherein the tubing has two opposite ends which are each adapted to be attached to a corresponding one of two objects for attaching the two objects together with the line;

the hollow tubing having a central section disposed between its opposite ends wherein the central section has opposite end portions and the fabric material of the central section is movable lengthwise between a gathered condition and a fully-stretched condition to accommodate a lengthening of the line as the opposite end portions of the central section are moved farther apart from a condition at which the central section is in a gathered condition and to accommodate a shortening of the line as the opposite end portions of the central section are moved closer together from a condition at which the central section is in a fully-stretched condition;

a bungee cord attached to the central section of the tubing for biasing the end portions of the central section toward one another to thereby bias the central section from the fully-stretched condition toward the gathered condition so that when the opposite ends of the tubing are attached between two objects capable of moving toward and away from one another, the biasing means opposes and thereby dampens the movement of the two objects away from one another and the distance that the two objects can be moved away from one another is limited by the length of the central section when in its fully-stretched condition and so that when the two objects move toward one another from the condition at which the central section is in its fully-stretched condition, the biasing means biases the central section toward the gathered condition, and wherein the bungee cord is elongated in form and has two opposite ends which are capable of being stretched lengthwise from a relaxed condition toward a stretched condition, and wherein the biasing means is disposed in such a relation to the central section of the tubing so that each end portion of the bungee cord corresponds with an end portion of the central section; and means for attaching each end portion of the central section to a corresponding end portion of the bungee cord so that the entire stretchable length of the bungee cord is in its relaxed condition, the central section is in its gathered condition and so that when the line is lengthened to the fully stretched condition of the central section, the central section of the tubing prevents the elongation of the entire stretchable length of the bungee cord beyond the stretched condition of the bungee cord.

12. The line as defined in claim 11 wherein the bungee cord is disposed within the central section of the tubing so that each portion of the bungee cord means corresponds with an end portion of the central section.

13. The line as defined in claim 12 wherein the means for attaching includes means for tightly binding each end portion of the central section about a corresponding end portion of the bungee cord.

14. The line as defined in claim 13 wherein the bungee cord includes at least one end which is folded over and secured upon itself and wherein the folded end of the bungee cord is positioned at a location along the length of the tubing which is disposed outboard of the means for tightly binding to reduce the likelihood that the means for tightly binding can be pulled over the folded end of the bungee cord.

15. The line as defined in claim 11 further comprising means associated with at least one of the opposite ends of the tubing for securing the at least one end of the tubing to a corresponding one of the two objects to be attached together.

16. The line as defined in claim 11 wherein the associated means includes strap means including a portion which can be looped about a corresponding one of the two objects to be attached together.

17. The line as defined in claim 16 wherein the material of the strap means is integrally formed with the material of the tubing.

18. The line as defined by claim 16 wherein the portion of the strap means capable of being looped includes sections which can be attached to one another to form a loop positionable about the corresponding one of the two objects to be attached together and which can be detached from one another to release the corresponding one of the two objects from the strap means.

19. The line as defined in claim 18 further comprising buckling components attached to the sections of the strap means and to one another to accommodate an adjustment in the size of the loop capable of being formed with the strap means.

20. The line as defined in claim 16 wherein the strap means includes means for adjusting the distance between the loop and the corresponding end portion of the central section to thereby adjust the total length of the line.

* * * * *